United States Patent [19]

Aihara et al.

[11] Patent Number: 5,026,257

[45] Date of Patent: Jun. 25, 1991

[54] VARIABLE DISPLACEMENT VANE-TYPE ROTARY COMPRESSOR

[75] Inventors: Toshinori Aihara; Masahiko Hara, both of Kanagawa, Japan

[73] Assignee: Atsugi Unisia Corporation, Atsugi, Japan

[21] Appl. No.: 407,366

[22] Filed: Sep. 14, 1989

[30] Foreign Application Priority Data

Sep. 14, 1988 [JP] Japan ..... 63-119817[U]

[51] Int. Cl.[5] ..... F04B 49/02

[52] U.S. Cl. ..... 417/295; 417/310

[58] Field of Search ..... 417/222, 295, 310

[56] References Cited

U.S. PATENT DOCUMENTS

| | | | |
|---|---|---|---|
| 4,813,854 | 3/1989 | Nakajima | 417/310 |
| 4,815,945 | 3/1989 | Nakajima et al. | 417/295 |
| 4,859,154 | 8/1989 | Aihara et al. | 417/295 |
| 4,865,524 | 9/1989 | Nakajima et al. | 417/295 |
| 4,869,652 | 9/1989 | Nakajima et al. | 417/310 |
| 4,878,814 | 11/1989 | Nakajima et al. | 417/295 |
| 4,890,985 | 1/1990 | Sugiura | 417/310 |

*Primary Examiner*—Leonard E. Smith
*Assistant Examiner*—John A. Savio, III
*Attorney, Agent, or Firm*—Bachman & LaPointe

[57] ABSTRACT

In a variable displacement vane-type rotary compressor, a rotational displacement of an adjust member relative to a front member fixedly closing a front end of a cam ring varies a compression starting point of a rotary vane in a working chamber formed in the cam ring. The front member is formed with an induction port and a bypass port, and the adjust member is formed with a bypass recess. The induction port and the bypass recess are in communication with each other in the working chamber irrespective of a position of the vane under all of the rotational displacement of the adjust plate to establish a communication between the induction port and the bypass port in the working chamber irrespective of the position of the vane when the bypass port overlaps with the bypass recess.

8 Claims, 7 Drawing Sheets

VARIABLE DISPLACEMENT VANE-TYPE ROTARY COMPRESSOR

BACKGROUND OF THE INVENTION

1. Field of the Invention

The present invention relates generally to a variable displacement vane-type rotary comressor. More specifically, the present invention relates to a variable displacement vane-type rotary compressor to be used as a refrigerant compressor for an air conditioner of a vehicle.

2. Description of the Background Art

In a variable displacement vane-type rotary compressor, a front plate fixedly closing a front end of a cam ring is formed with a pair of induction ports and a pair of bypass ports and an adjust plate formed with a corresponding pair of bypass openings is rotatably fitted into a central circular recess formed on the rear side of the front plate. A rotational displacement of the adjust plate varies a position of each bypass opening relative to the corresponding induction port and bypass port so as to control a compression starting point of a rotary vane in a working chamber provided in the cam ring. This type of the variable displacement vane-type rotary compressor is disclosed, for example, in a First Japanese Patent Publication No. 63-41692.

FIG. 1 shows a front plate and an adjust plate which are used in such a rotary compressor. A disk-shaped front plate 2 is formed at its center with a circular recess 4. The circular recess 4 is formed at its bottom with a pair of induction ports 6 located in a rotation symmetry with respect to a rotation axis of a rotor or an axis of the compressor, and with a pair of bypass ports 8 located in a rotation symmetry with respect to the rotation axis of the rotor. Each induction port 6 includes a recessed portion 10 which is formed by cutting out a portion of the circumferential wall 12 in a manner to enlarge dimensions of the opening, formed through the bottom of the circular recess 4, of the induction port 6. The bypass port 8 is located by spacing a predetermined distance from the induction port 6 in a direction along the rotation of the rotor, as indicated by an arrow in FIG. 1. Each induction port 6 and the corresponding bypass port 8 are arranged such that when a leading edge, with respect to the rotational direction of the rotor, of a sickle-shaped working chamber formed in the cam ring matches a leading end 14 of the induction port 6, a trailing end 16, with respect to the rotational direction of the rotor, of the bypass port 8 is located in the vicinity of a discharge port provided at a trailing end of the sickle-shaped working chamber.

The adjust plate 18 is rotatably fitted into the circular recess 4 with its circumferential periphery being in slidable contact with the circumferential wall 12 and with its front surface being in slidable contact with the bottom of the circular recess 4. In this condition, a rear surface of the adjust plate 18 is on a level with a rear annular surface of the front plate 2.

A pair of bypass openings 20, in the form of recessed cut-outs, are formed on the circumferential periphery of the adjust plate 18. The bypass openings 20 are located in a rotation symmetry with respect to the rotational axis of the rotor. Each bypass opening is of a size similar to that of the corresponding induction port 6.

A rotational displacement of the adjust plate 18 is controlled by control means provided in the compressor to vary a position of each bypass opening 20 relative to the corresponding induction port 6 and bypass port 8 so as to adjust a compression starting point of the rotary vane within the sickle-shaped working chamber. As shown in FIG. 2(A), the compression starting point is most advanced to maximize its discharge when the induction port 6 and the bypass opening 20 coincide with each other, i.e. the bypass opening 20 coincide with each other, i.e. the bypass opening 20 is only in communication with the induction port 6 and not in communication with the bypass port 8. This is because no working refrigerant which is introduced in to the sickle-shaped working chamber from an induction chamber through the induction port 6 and the bypass opening 20, is returned into the induction chamber through the bypass port 8. In this condition, the rotational displacement of the adjust plate is minimum. As shown in FIG. 2(B), the compression starting point is between most advanced and most retarded to make its discharge intermediate when a leading end 22, with respect to the rotational direction of the rotor, of the bypass opening 20 exceeds a trailing end 24 of the induction port 6 by predetermined distances in the rotational direction of the rotor. This is because a portion of the working refrigerant introduced through the recessed portion 10 of the induction port 6 is returned into the induction chamber through the bypass opening 20 and the bypass port 8, and the compression by the rotary vane starts after the rotary vane reaches a trailing end 26 of the bypass opening 20. In this condition, the rotational displacement of the adjust plate 18 is intermediate. As shown in FIG. 2(C), the compression starting point is most retarded to minimize its discharge when the trailing end 26 of the bypass opening 20 substantially coincide with the trailing end 16 of the bypass port 8. This is because most of the working refrigerant introduced through the recessed portion 10 of the induction port 6 is returned into the induction chamber through the bypass opening 20 and the bypass port 8, and the compression by the rotary vane starts after the rotary vane reaches the trailing end 26 of the bypass opening 20, which is close to the discharge port. In this condition, the rotational displacement of the adjust plate 18 is maximum.

The structure described above, however, involves the following problems.

In FIG. 2(*a*) where the compression starting point is most advanced, since a sufficient amount of the working refrigerant is introduced into the working chamber through the matched induction port 6 and bypass opening 20, no serious questions is raised. However, in FIGS. 2 (B) and (C), since the working refrigerant is introduced into the working chamber only through the recessed portion 10 of the induction port 6, the induction amount of the working refrigerant is insufficient to cause the power loss due to the pressure differential between forward and rearward of the rotary vane in the rotational direction of the rotor. Further, in FIGS. 2 (B) and (C), when the rotary vane is located between the recessed portion 10 of the induction port 6 and the bypass opening 20, the vane defines two sections in the working chamber forward and rearward of the vane, which are discommunicated with each other. Accordingly, the working refrigerant first introduced into the working chamber from the induction chamber through the recessed portion 10 of the induction port 6 is returned into the induction chamber through the bypass opening 20 and the bypass port 8, and is again introduced into the working chamber through the recessed portion 10. This recirculation of the working refrigerant causes agitation of the working refrigerant to increase a temperature thereof. This induces a lowering of durability of the compressor.

SUMMARY OF THE INVENTION

Therefore, it is an object of the present invention to provide a variable displacement vane-type rotary compressor which can prevent the above mentioned power loss due to the pressure differential between forward and rearward of the vane when the compressor is operated with the rotational displacements of the adjust plate being minimum and intermediate.

Another object of the present invention is to provide a variable displacement vane-type rotary compressor which can prevent the above mentioned temperature increase of the working refrigerant when the compressor is operated with all the rotational displacements of the adjust plate.

To accomplish the above mentioned and other objects, according to one aspect of the present invention, a variable displacement vane-type rotary compressor comprises a cam ring, a front member closing a front end of the cam ring, the front member having induction opening means and first bypass opening means, a rear member closing a rear end of the cam ring, a rotor rotatably provided in the cam ring between the front and rear members to define working chamber means in the cam ring, the rotor having a plurality of vanes each of which is reciprocatively mounted to the rotor for compressing working fluid introduced from an induction chamber provided in the compressor into the working chamber means through the induction opening means and for discharging the compressed working fluid from the working chamber means into a discharge chamber provided in the compressor, an adjust member having second bypass opening means, the adjust member rotatably provided in the cam ring between the rotor and the front member, a rotational displacement of the adjust member changing a position of the second bypass opening means relative to the induction opening means and the first bypass opening means so as to vary a compression starting point of the vane in the working chamber means.

The induction opening means and the second bypass opening means being effectively communicated with each other in the working chamber means under all of the rotational displacement of the adjust member irrespective of a position of the vane to establish a communication between the first bypass opening means and the induction opening means in the working chamber means irrespective of the position of the vane when the first bypass opening means overlaps with the second bypass opening means.

BRIEF DESCRIPTION OF THE DRAWINGS

The present invention will be understood more fully from the detailed description given hereinbelow and from the accompanying drawings of the preferred embodiment of the invention, which are given by way of example only, and are not intended to be limitative of the present invention.

In the drawings.

DESCRIPTION OF THE PREFERRED EMBODIMENT

Figure 3:
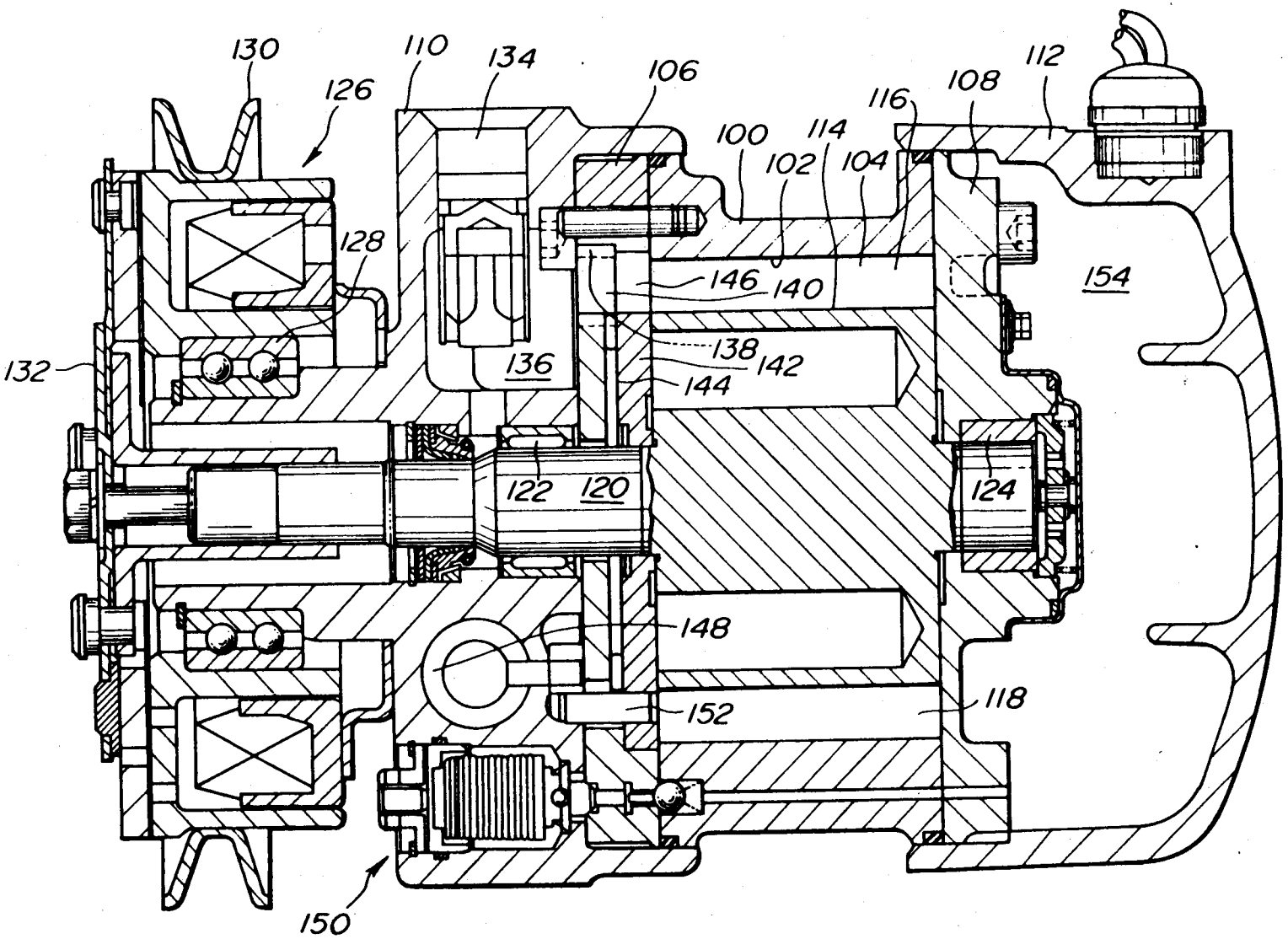
FIG. 3 is a longitudinal section showing a variable displacement vane-type rotary compressor according to a preferred embodiment of the present invention.

FIG. 3 shows a variable displacement vane-type rotary compressor of a concentric type which is to be used as a refrigerant compressor for an air conditioner of a vehicle.

In FIG. 3, a cam ring 100 has a cam surface 102 on its inner circumference. The cam surface 102 defines therein an axial space 104 which is of an elliptical shape in cross section. Front and rear ends of the cam ring 100 are fixedly closed by a front plate 106 and a rear plate 108, respectively. The front plate 106 is further fixed to a head cover 110 which is also fixed to a front end of the outer periphery of the cam ring 100. Similarly, the rear plate 108 is further fixed to a rear cover 112 which is also fixed to a rear end of the outer periphery of the cam ring 100.

A cylindrical rotor 114 is rotatably received in the elliptical space 104 to define a pair of working chambers 116 in the elliptical space 104, i.e. inside the cam ring 100. The working chambers 116 are formed at opposite locations to each other with respect to the rotational axis of the rotor 114, each having a sickle-shape in section. The rotor 114 is provided with a plurality of vanes 118 each of which is reciprocatively inserted in a corresponding slit formed in the rotor 114 and is constantly in slidable contact with the cam surface 102 at its tip during rotation of the rotor 114.

A rotating shaft 120 is integrally formed with the rotor 114 and is rotatably supported by the head cover 110 and the rear plate 108 by means of bearings 122, 124. Onto a boss portion of the head cover 110 is mounted an electromagnetic clutch 126 through a bearing 128. The clutch 126 has a pulley 130 connected to the rotating shaft 120 through a clutch plate 132 so as to transmit the torgue from the engine to the rotating shaft 120. When the pulley 130 is rotated by the engine to rotate the rotor 114 through the rotating shaft 120, the vanes 118 project radially due to centrifugal force applied thereto and back pressure of the vanes 118, so that the tips of the vanes get constantly in contact with the cam surface 102 of the cam ring 100 during the rotation of the rotor.

The head cover 110 is formed therein with an inlet port 134 which receives the working fluid, i.e. the refrigerant from an evaporator, and an induction chamber 136 communicating with the inlet port 134. The front plate 106 is formed therethrough with a pair of induction ports 138 and a pair of bypass ports 140. The induction ports 138 are formed at opposite locations to each other with respect to the rotational axis of the rotor 114 and the bypass ports 140 are also formed at opposite locations to each other with respect to the axis of the rotor 114. The induction ports 138 and the bypass ports 140 are constantly in communication with the induction chamber 136.

Between the rotor 114 and the front plate 106 is provided an adjust plate 142 which is fitted in a central circular recess 144 formed on the rear side of the front plate 1066 and is rotatable about the rotating shaft 120. The adjust plate 142 is formed with a pair of bypass openings 146 in the form of recessed cut-outs formed on the circumferential periphery of the adjust plate 142. The bypass openings 146 are located oppositely to each other with respect to the rotational axis of the rotor 114 or the axis of the compressor. The adjust plate 142 is actuated by an adjust plate actuating unit 148 to which a pilot pressure is applied by a pilot pressure applying unit 150. Specifically, the adjust plate actuating unit 148 includes a piston type actuator which moves between two extreme positions according to the pilot pressure applied thereto by the pilot pressure applying unit 150. The movement of the piston is transmitted to the adjust plate 142 through a pin 152 to control the rotational displacement of the adjust plate 142. By rotating the adjust plate 142, a position of each bypass opening 146 relative to the corresponding induction port 138 and bypass port 140 is varied to adjust a compression starting point of the vane so as to control a discharge of the pressurized refrigerant to be discharged from the working chambers 116 into a discharge chamber 154 defined between the rear plate 108 and the rear cover 112. Specifically, when the bypass openings 146 are in communication with only the induction ports 138 and not in communication with the bypass ports 140, since the working refrigerant introduced into the working chambers 116 through the induction chamber 136, the induction ports 138 and the bypass openings 146 is prevented from escaping or bypassing through the bypass ports 140, the compression starting point is most advanced so that the discharge of the pressurized refrigerant is maximum. On the other hand, as the adjust plate 142 is rotated to communicate the bypass openings 146 with the bypass ports 140, the bypass amount of the working refrigerant through the bypass openings 146 and the bypass ports 140 gets larger to retard the compression starting point of the vane, so that the discharge of the compressed refrigerant gets less. The compressed refrigerant is discharged from the working chambers 116 into the discharge chamber 154 through a pair of discharge ports (not shown) formed in the cam ring 100 between the cam surface 102 and the outer periphery of the cam ring 100 and through a discharge valve provided in the corresponding discharge port, in accordance with the pressure generated in the working chambers 116.

Figure 4:
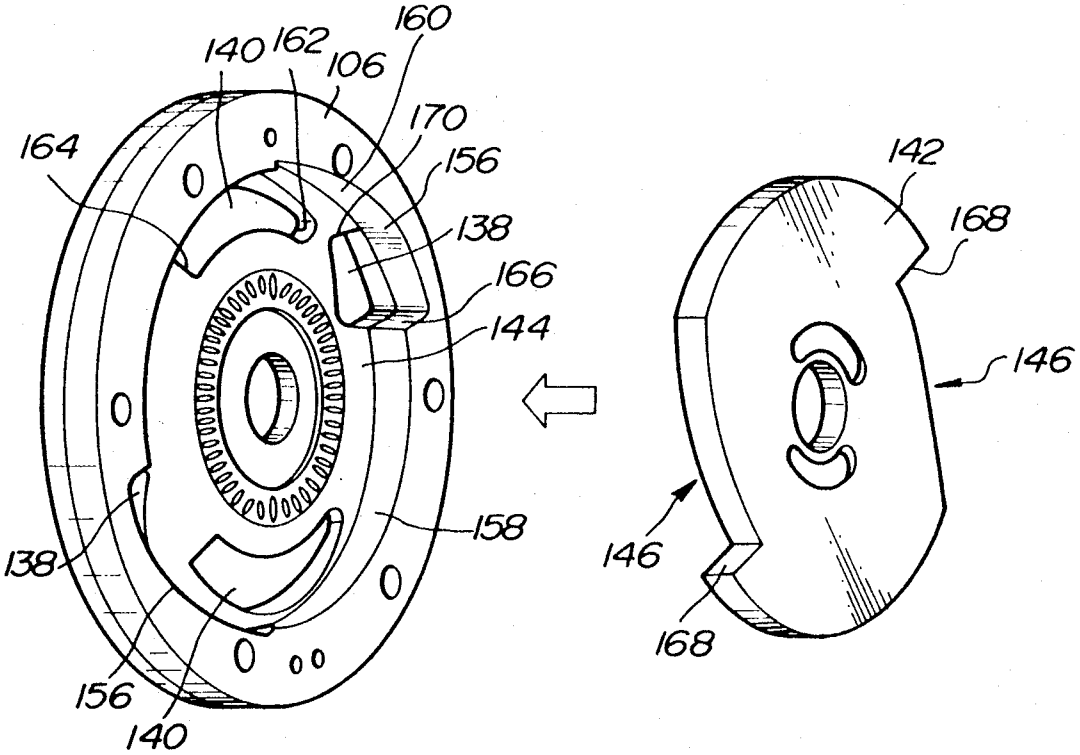
FIG. 4 is an exploded perspective view showing a front plate and an adjust plate according to a first preferred embodiment of the present invention.

FIG. 4 shows a first preferred embodiment of the front plate 106 and the adjust plate 142 according to the present invention.

As shown in FIG. 4, the disk-shaped front plate 106 is formed on its rear side with the central circular recess 144. The circular recess 144 is formed at its bottom with a pair of the induction ports 138 located in a rotation symmetry with respect to the roration axis of the rotor 114, and with a pair of the bypass ports 140 located in a rotation symmetry with respect to the rotation axis of the rotor 114. Each induction port 138 includes a recessed portion 156 which is formed by cutting out a portion of a circumferential wall 158 in a manner to enlarge dimensions of the opening, formed through the bottom of the circular recess 144, of the induction port 138. Each induction port 138 further includes a recessed portion 160 which is formed by cutting out a portion of the circumferential wall 160 in a manner not to enlarge the dimensions of the opening itself, formed through the bottom of the circular recess 144, of the induction port 138 and extends from the recessed portion 156 to a predetermined point corresponding to a point between a leading end 162, with respect to the rotational direction of the rotor 114, of the bypass port 140 and a trailing end 164 thereof. The bypass port 140 is located spacing a predetermined distance from the induction port 138 in a direction along the rotation of the rotor 114. Each induction port 138 and the corresponding bypass port 140 are arranged such that when a leading edge, with respect to the rotational direction of the rotor, of a sickle-shaped working chamber 116 matches a leading end 166 of the induction port 138, the trailing end 164 of the bypass port 140 is located in the vicinity of the discharge port provided at a trailing end of the sickle-shaped working chamber 116.

The adjust plate 142 is rotatably fitted into the circular recess 144 with its circumferential periphery being in slidable contact with the circumferential wall 158 and with its front surface being in slidable contact with the bottom of the circular recess 144. In this condition, a rear surface of the adjust plate 142 is on a level with a rear annular surface of the front plate 106.

A pair of the bypass openings 146, in the form of recessed cut-outs, are formed on the circumferential periphery of the adjust plate 142. The bypass openings 146 are located in a rotation symmetry with respect to the rotational axis of the rotor 114 or the axis of the compressor. A trailing end 168 of the bypass opening 146, which corresponds to a compression starting point of the vane, is located in the same position as in the background art. On the other hand, the bypass opening 146 extends a predetermined distance from the trailing end 168 in a direction opposite to the rotational direction of the rotor 114 such that when the adjust plate 142 is rotationally displaced at maximum in the rotational direction of the rotor, a predetermined portion of the bypass opening 146 overlaps with the recessed portion 160 of the induction port 138.

Figures 2A, 2B, 2C:
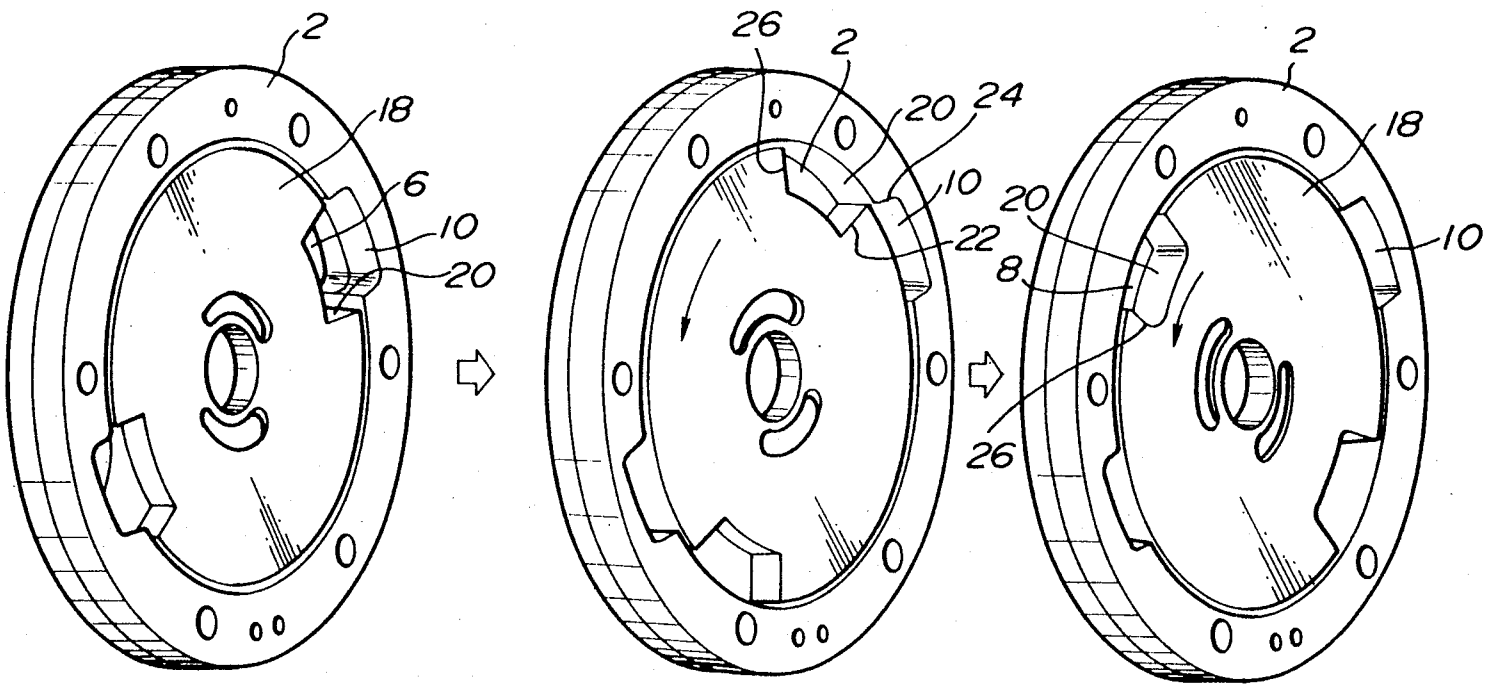
FIG.2(A) PRIOR ART
FIG.2(B) PRIOR ART
FIG.2(C) PRIOR ART
FIGS. 2 (A) (B) (C) respectively show a structural relationship between the front plate and the adjust plate of FIG. 1 corresponding to the rotational displacements of the adjust plate being minimum, intermediate and maximum.
Figures 5A, 5B, 5C:
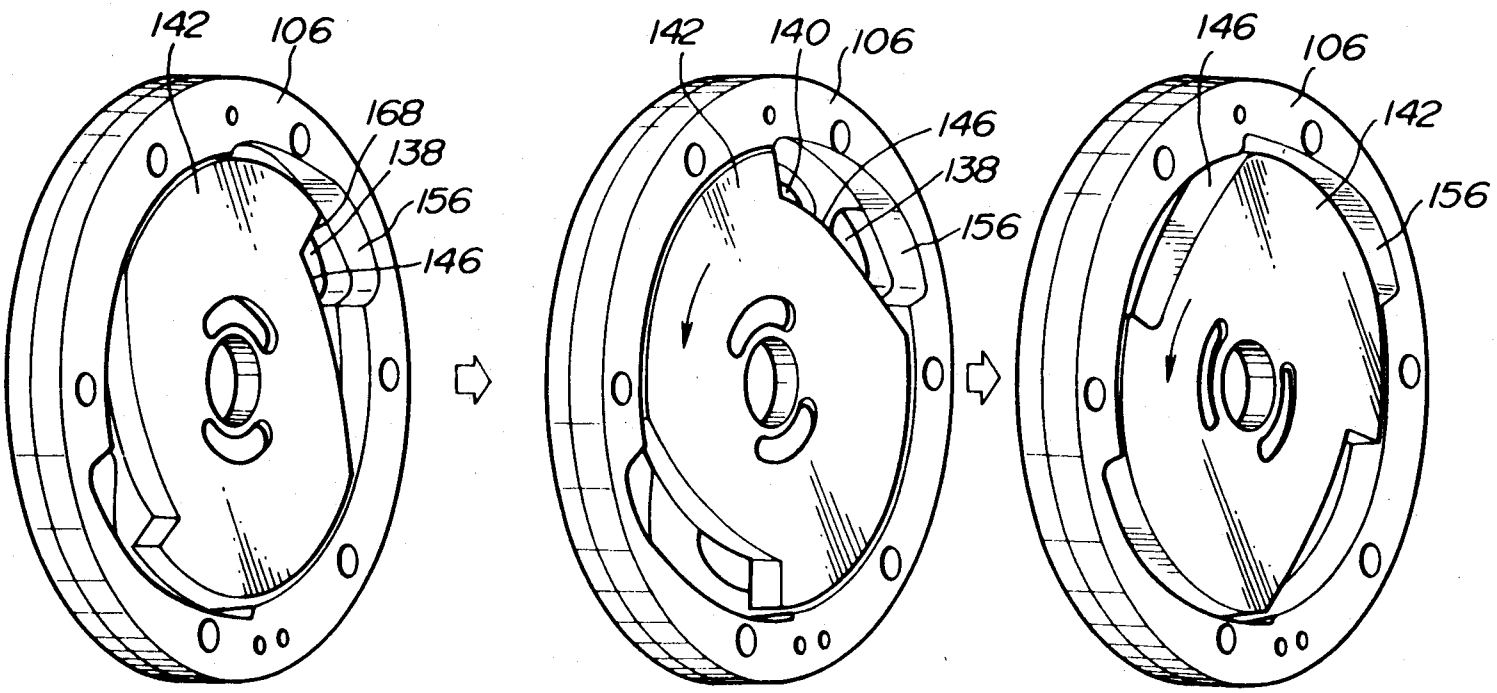
FIGS. 5 (A) (B) (C) respectively show a structural relationship between the front plate and the adjust plate of FIG. 4 corresponding to the rotational displacements of the adjust plate being minimum, intermediate and maximum.

The structure described above works as follows. When the trailing end 168 of the bypass opening 146 substantially matches with a trailing end 170 of the opening, formed through the bottom of the circular recess 144, of the induction port 138 as shown in FIG. 5(A) to most advance the compression starting point of the vane, an induction amount of the working refrigerant is substantially the same as in the background art as shown in FIG. 2(A). When the trailing end 168 of the bypass opening 146 passes over the trailing end 170 of the induction port 138 as shown in FIG. 5(B) to render the compression starting point of the vane intermediate, since the opening of the induction port 138 is not closed by the adjust plate 142, a sufficient amount of the working refrigerant is introduced through the opening of the induction port 138 and the extended portion of the bypass opening 146. Further, since the induction port 138 and the bypass port 140 are in communication with each other even when the vane is located between the opening of the induction port 138 and the bypass port 140, the recirculation of the working refrigerant described with reference to the background art as shown in FIG. 2(B) is effectively prevented. When the trailing end 168 of the bypass opening 146 substantially matches with the trailing end of the bypass port 140 as shown in FIG. 5(C) to most retard the compression starting point of the vane, since the induction port 138 and the bypass port 140 are in communication with each other through the recessed portions 156, 160 of the induction port 138 and the bypass port 140 irrespective of a position of the vane, the recirculation of the working refrigerant described with reference to the background art as shown in FIG. 2(C) is effectively prevented. In FIG. 5(C), an induction amount of the working refrigerant is substantially the same as in the background art as shown in FIG. 2(C).

Figure 6:
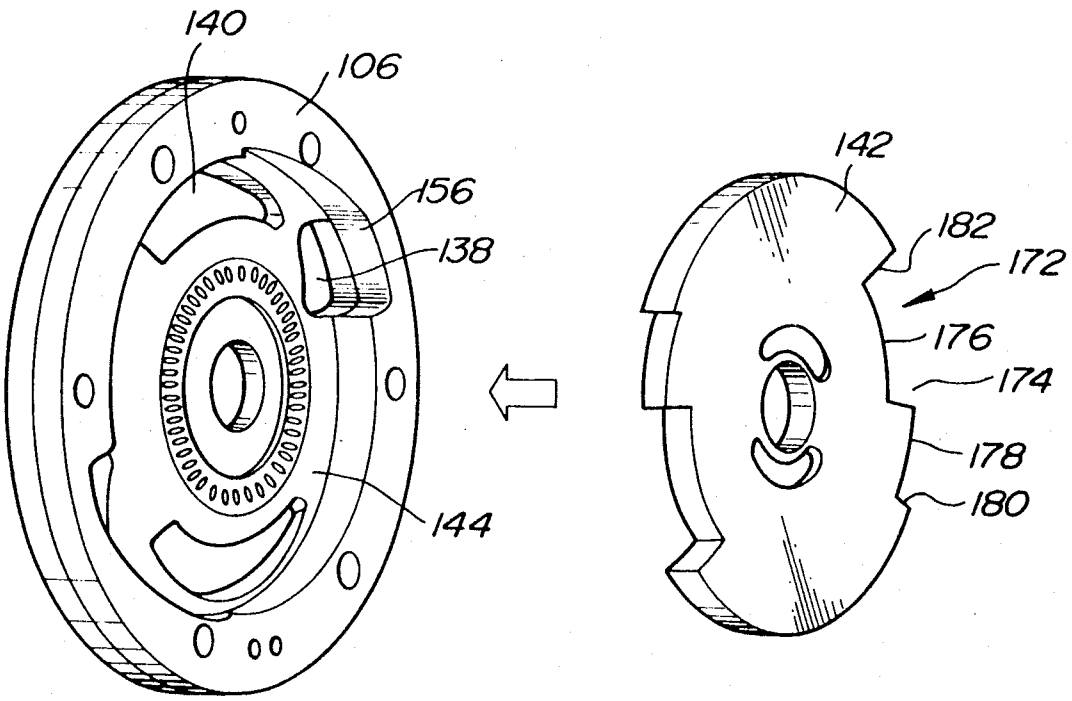
FIG. 6 is an exploded perspective view showing a front plate and an adjust plate according to a second preferred embodiment of the present invention.

FIG. 6 shows a second preferred embodiment of the front plate and the adjust plate according to the present invention. The same or similar portions are denoted by the same reference numerals as in FIGS. 4 and 5.

Figure 1:
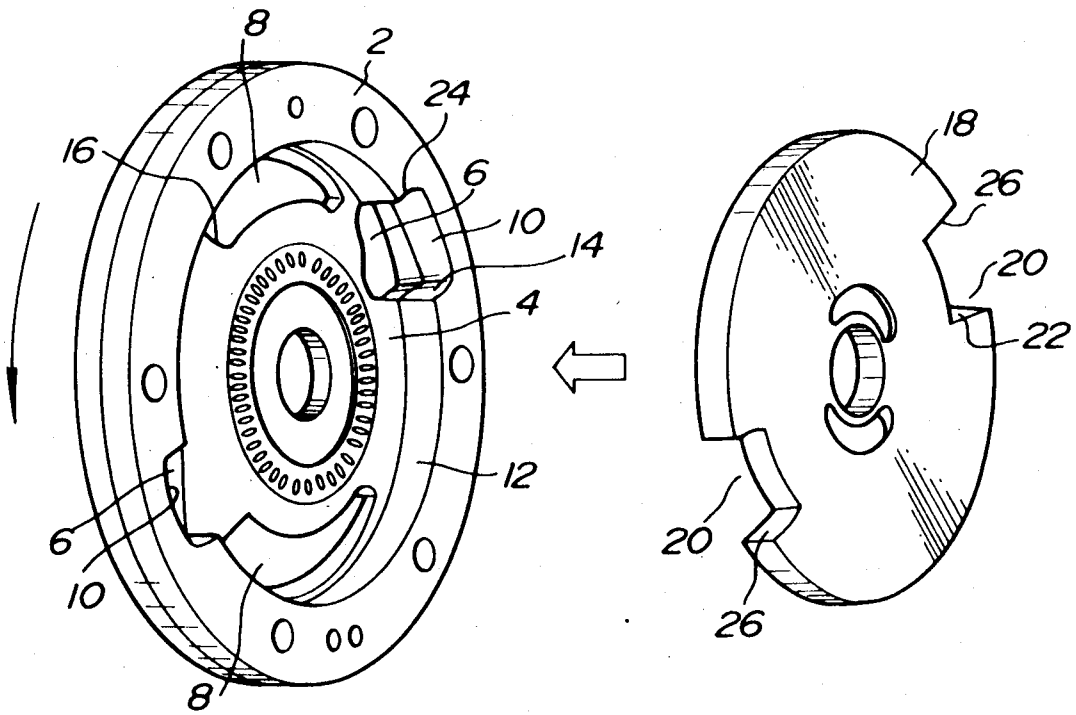
FIG. 1 PRIOR ART
FIG. 1 is an exploded perspective view showing a front plate and an adjust plate of the background art.

In FIG. 6, the structure of the front plate 106 is the same as that of FIG. 4. The structure of the adjust plate 142 is also the same as that shown in FIG. 4 except for the shape of the bypass opening. Specifically, a bypass opening 172 is formed with a stepped bottom 174 having a first section 176 and a second section 178. The first section 176 is formed deeper that the second section 178. Further, the first section is formed longer than the bottom of the bypass opening 20 of the background art as shown in FIG. 1. Locations of a leading end 180 and a trailing end 182 of the bypass opening 172 are set the same as those of the bypass opening 146 as shown in FIG. 4.

Figures 7A, 7B, 7C:
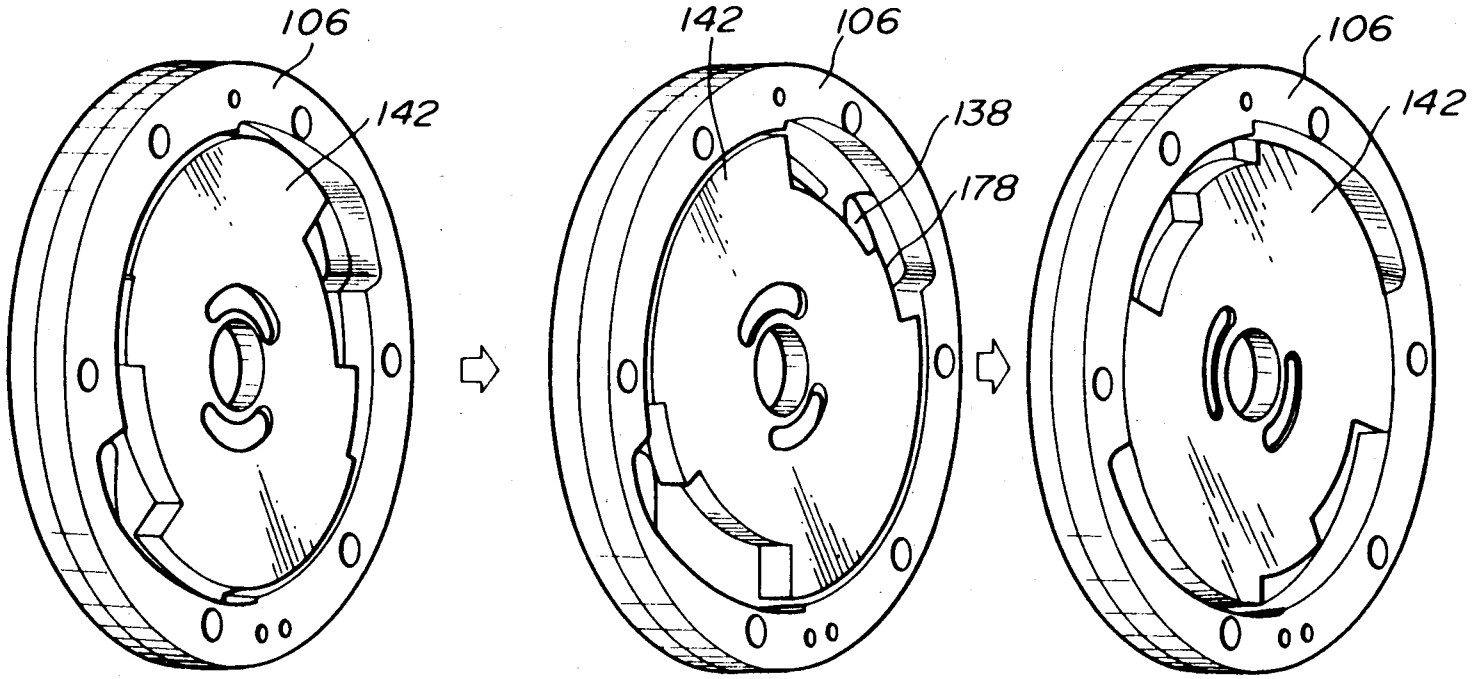
FIGS. 7 (A) (B) (C) respectively show a structural relationship between the front plate and the adjust plate of FIG. 6 corresponding to the rotational displacements of the adjust plate being minimum, intermediate and maximum.

Obviously, the structure of the second preferred embodiment as mentioned above works substantially the same as the first preferred embodiment as shown in FIGS. 4 and 5, except that the induction amount of the working refrigerant becomes larger in FIG. 7(B) than in FIG. 5(B) since the induction port 138 is opened wider through the first section 176 of the bypass opening 172 than in FIG. 5(B).

It is to be understood that the invention is not to be limited to the embodiments described above, and that various changes and modifications may be made without departing from the spirit and scope of the invention as defined in the appended claims.

What is claimed is:

1. A variable displacement vane-type rotary compressor comprising: a cam ring;

a front member closing a front end of said cam ring, said front member having a pair of induction ports located in a rotation symmetry with respect to an axis of the compressor, a pair of bypass ports located in a rotation symmetry with respect to the axis of the compressor, and recess means communicating with each of said induction ports and extension therefrom so as to overlap a portion of one of each of said pair of bypass ports;

a rear member closing a rear end of said cam ring;

a rotor rotatably provided in said cam ring between said front and rear members to define working chamber means in said cam ring, said rotor having a plurality of vanes each of which is reciprocatively mounted to said rotor for compressing working fluid introduced from an induction chamber provided in said compressor into said working chamber means through said induction opening means and for discharging the compressed working fluid from said working chamber into a discharge chamber provided in said compressor;

an adjust member having a pair of bypass openings, said adjust member rotatably provided in said cam ring between said rotor and said front member, a rotational displacement of said adjust member changing a position of said bypass openings relative to said induction ports and said bypass ports so as to vary a compression starting point of the vane in said working chamber means;

said induction ports and said bypass openings being effectively communicated with each other in said working chamber means under all of said rotational displacement of said adjust member irrespective of a position of the vane to establish a communication between said bypass ports and said induction ports in said working chamber means via said recess means and said bypass openings irrespective of the position of the vane when said bypass ports overlap with said bypass openings.

2. A variable displacement vane-type rotary compressor as set forth in claim 1, wherein each of said induction ports include first recess means formed on said front member, said first recess means extending from a leading end, with respect to a rotational direction of the rotor, of said induction ports by a predetermined distance in a direction of the rotation of the rotor, and said bypass openings include second recess means formed on said adjust member, said second recess means extending from a trailing end, with respect to the rotational direction of the rotor, of said bypass openings by a predetermined distance in a direction opposite to the rotation of the rotor such that when said adjust member is most displaced in the rotational direction of the rotor, a predetermined portion of said second recess means overlaps with said first recess means.

3. A variable displacement vane-type rotary compressor as set forth in claim 2, said second recess means includes a stepped bottom having first and second sections, said first section located closer to said trailing end and being formed deeper than said second section.

4. A variable displacement vane-type rotary compressor comprising:

a cam ring;

a front plate closing a front end of said cam ring, said front plate formed at its rear side with a circular recess having a bottom and a circumferential wall surrounding the bottom, said bottom formed with a pair of induction ports located in a rotation symmetry with respect to an axis of the compressor, and a pair of bypass ports located in a rotation symmetry with respect to the axis of the compressor, each induction port having an opening formed through said bottom, a recessed opening being continuous with said opening and formed on a first portion of said circumferential wall in a manner to enlarge said opening, and a recess formed on a second portion of said circumferential wall in a manner to be continuous with said first portion of said circumferential wall;

a rear member closing a rear end of said cam ring;

a rotor rotatably provided in said cam ring between said front and rear plates to define a pair of working chambers in said cam ring, said working chambers being located in a rotation symmetry with respect to the axis of the compressor, said rotor having a plurality of vanes each of which is reciprocatively mounted to said rotor for compressing working fluid introduced from an induction chamber provided in said compressor into each working chamber through said induction port and for discharging the compressed working fluid from said working chamber into a discharge chamber provided in said compressor;

an adjust plate having a pair of bypass openings located in a rotation symmetry with respect to the axis of the compressor, each bypass opening being in the form of a recess formed on a circumferential periphery of said adjust plate, said adjust plate rotatably provided in said cam ring between said rotor and said front plate, a rotational displacement of said adjust plate changing a position of each bypass opening relative to the corresponding induction port and bypass port so as to vary a compression starting point of the vane in each working chamber;

said recesses of said induction ports each extending from said first portion of the circumferential wall by a predetermined distance in a rotational direction of the rotor so as to overlap a portion of the bypass port;

said bypass openings each extending from its trailing end, with respect to the rotational direction of the rotor, by a predetermined distance in a direction opposite to the rotation of the rotor such that when said adjust plate is most displaced in the rotational direction of the rotor, a predetermined portion of said bypass opening overlaps with said recess of the induction port so as to establish a communication between said induction port and said bypass opening in said working chamber under all of said rotational displacement of the adjust plate irrespective of a position of the vane, so that a communication is established between said induction port and said bypass port in said working chamber irrespective of the position of the vane when said bypass port overlaps with said bypass opening.

5. A variable displacement vane-type rotary compressor as set forth in claim 4, wherein each of said recesses of the adjust plate includes a stepped bottom having first and second sections, said first section located closer to said trailing end and being formed deeper than said second section.

6. A variable displacement vane-type rotary compressor comprising:

a cam ring;

a front plate closing a front end of said cam ring, said front plate formed at its rear side with a circular recess having a bottom and a circumferential wall surrounding the bottom, said bottom formed with induction port means and bypass port means, said induction port means having an opening formed through said bottom, a recessed opening being continuous with said opening and formed on a first portion of said circumferential wall in a manner to enlarge said opening, and a recess formed on a second portion of said circumferential wall in a manner to be continuous with said first portion of said circumferential wall;

a rear member closing a rear end of said cam ring;

a rotor rotatably provided in said cam ring between said front and rear plates to define working chamber means in said cam ring, said rotor having a plurality of vanes each of which is reciprocatively mounted to said rotor for compressing working fluid introduced from an induction chamber provided in said compressor into said working chamber means through said induction port means and for discharging the compressed working fluid from said working chamber means into a discharge chamber provided in said compressor;

an adjust plate having bypass recess means formed on a circumferential periphery of said adjust plate, said adjust plate rotatably provided in said cam ring between said rotor and said front plate, a rotational displacement of said adjust plate changing a portion of said bypass recess means relative to said induction port means and said bypass port means so as to vary a compression starting point of the vane in said working chamber means;

said recess of said induction port means extending from said first portion of the circumferential wall by a predetermined distance in a rotational direction of the rotor so as to overlap a portion of the bypass port;

said bypass recess means extending from its trailing end, with respect to the rotational direction of the rotor, by a predetermined distance in a direction opposite to the rotation of the rotor such that when said adjust plate is most displaced in the rotational direction of the rotor, a predetermined portion of said bypass recess means overlaps with said recess of the induction port means so as to establish a communication between said induction port means and said bypass recess means in said working chamber under all of said rotational displacement of the adjust plate irrespective of a position of the vane, so that a communication is established between said induction port means and said bypass port means in said working chamber irrespective of the position of the vane when said bypass port means overlaps with said bypass recess means.

7. A variable displacement vane-type rotary compressor as set forth in claim 6, wherein said bypass recesse means includes a stepped bottom having first and second sections, said first section located closer to said trailing end and being formed deeper than said second section.

8. A variable displacement vane-type rotary compressor comprising:

a cam ring;

a front member closing a front end of said cam ring, said front member having induction opening means and first bypass opening means, said front member further including recess means which communicates with said induction opening means;

a rear member closing a rear end of said cam ring;

a rotor rotatably provided in said cam ring between said front and rear members to define working chamber means in said cam ring, said rotor having a plurality of vanes each of which is reciprocatively mounted to said rotor for compressing working fluid introduced from an induction chamber provided in said compressor into said working chamber means through said induction opening means and for discharging the compressed working fluid from said working chamber into a discharge chamber provided in said compressor;

an adjust member having a pair of bypass openings, said adjust member rotatably provided in said cam ring between said rotor and said front member, a rotational displacement of said adjust member changing a position of said bypass openings relative to said induction ports and said bypass ports so as to vary a compression starting point of the vane in said working chamber means;

said recess means extending from said induction opening means by a predetermined distance in a rotational direction of the rotor so as to overlap a portion of said first bypass opening means; and said second bypass opening means extending from its trailing end, with respect to the rotational direction of the rotor, by a predetermined distance in a direction opposite to the rotation of the rotor such that when said adjust member is most displaced in the rotational direction of the rotor, a predetermined portion of said second bypass opening means overlaps said recess means so as to establish a communication between said induction opening means and said second bypass opening means in said working chamber means under all of said rotational displacement of the adjust member irrespective of a position of the vane, so that a communication is established between said induction opening means and said first bypass opening means in said working chamber means irrespective of the position of the vane when said first bypass opening means overlaps said second bypass opening means.

* * * * *